US009920490B2

(12) United States Patent
Sylvester

(10) Patent No.: US 9,920,490 B2
(45) Date of Patent: Mar. 20, 2018

(54) MODULAR PAVEMENT SYSTEM

(71) Applicant: Integrated Roadways, LLC, Kansas City, MO (US)

(72) Inventor: Tim Sylvester, Raytown, MO (US)

(73) Assignee: Integrated Roadways, LLC, Kansas City, MO (US)

( * ) Notice: Subject to any disclaimer, the term of this patent is extended or adjusted under 35 U.S.C. 154(b) by 0 days.

(21) Appl. No.: 15/156,001

(22) Filed: May 16, 2016

(65) Prior Publication Data

US 2017/0191227 A1 Jul. 6, 2017

Related U.S. Application Data

(60) Provisional application No. 62/275,093, filed on Jan. 5, 2016.

(51) Int. Cl.

| | |
|---|---|
| ***E01C 5/00*** | (2006.01) |
| ***E01C 5/06*** | (2006.01) |
| ***E01C 11/18*** | (2006.01) |

(52) U.S. Cl.

CPC ..... *E01C 5/005* (2013.01); *E01C 5/06* (2013.01); *E01C 11/18* (2013.01); *E01C 2201/02* (2013.01)

(58) Field of Classification Search

CPC ... E01C 5/005; E01C 5/06; E01C 5/00; E01C 11/18; E01C 11/24; E01C 2201/02

See application file for complete search history.

(56) References Cited

U.S. PATENT DOCUMENTS

| | | | | |
|---|---|---|---|---|
| 2,448,134 | A * | 8/1948 | Abel | E01C 5/005 404/63 |
| 3,534,668 | A | 10/1970 | Scheincha | |
| 5,586,834 | A | 12/1996 | Tsuji | |
| 5,626,289 | A | 5/1997 | Demers, Jr. et al. | |
| 5,797,231 | A | 8/1998 | Kramer | |
| 6,389,774 | B1 | 5/2002 | Carpenter | |
| 6,688,808 | B2 | 2/2004 | Lee | |
| 6,692,184 | B1 * | 2/2004 | Kelly | E01C 7/147 404/52 |
| 6,709,192 | B2 | 3/2004 | Smith | |
| 6,758,023 | B1 | 7/2004 | Sorkin | |
| 6,827,521 | B2 * | 12/2004 | Sproules | E01C 5/08 404/17 |
| 7,134,805 | B2 | 11/2006 | Yee | |

(Continued)

FOREIGN PATENT DOCUMENTS

EP 1878854 A2 1/2008

OTHER PUBLICATIONS

International Search Report and Written Opinion for PCT/US2013/029992, dated Jun. 4, 2015, 11 pages.

*Primary Examiner* — Abigail A Risic
(74) *Attorney, Agent, or Firm* — Hovey Williams LLP

(57) ABSTRACT

A prefabricated paving slab includes specialized combinations of substantially vertical passages and cavities to enable "drop in" installation. The paving slab may include retractable coupling rods aligned using spacers having seating surfaces and alignment surfaces. Cavities of the paving slab, each configured for receiving a coupling rod, preferably are arranged in orientation(s) and pattern(s) selected for receiving and transferring the stresses of loads travelling in a pre-determined direction.

27 Claims, 18 Drawing Sheets

(56) References Cited

U.S. PATENT DOCUMENTS

| | | | | |
|---|---|---|---|---|
| 7,441,984 | B2 * | 10/2008 | Kramer | E01C 11/14 404/52 |
| 7,632,037 | B2 * | 12/2009 | Brinkman | E01C 11/14 404/58 |
| 8,511,935 | B1 * | 8/2013 | Thomas | E01C 11/14 404/135 |
| 8,756,898 | B1 * | 6/2014 | Backhaus | E04B 5/023 404/47 |
| 8,911,173 | B2 | 12/2014 | Ulislam et al. | |
| 8,919,058 | B2 | 12/2014 | Liberman | |
| 9,032,791 | B2 | 5/2015 | Duncan | |
| 2005/0144866 | A1 | 7/2005 | Chappell et al. | |
| 2006/0177269 | A1 * | 8/2006 | Kramer | E01C 11/14 404/60 |
| 2009/0116906 | A1 | 5/2009 | Kaylor et al. | |
| 2011/0262263 | A1 | 10/2011 | Comerford et al. | |
| 2013/0115000 | A1 | 5/2013 | Smith | |
| 2013/0209171 | A1 * | 8/2013 | Thomas | E01C 11/14 404/62 |
| 2014/0270947 | A1 | 9/2014 | Ulislam | |
| 2015/0078822 | A1 * | 3/2015 | Backhaus | E01C 5/06 404/47 |

* cited by examiner

MODULAR PAVEMENT SYSTEM

CROSS-REFERENCE TO RELATED APPLICATION

The present application claims the benefit of U.S. Provisional Application Ser. No. 62/275,093, filed Jan. 5, 2016, and entitled BLOW-OUT DOWEL; the entirety of which is hereby incorporated herein by reference, to the extent permitted by law.

BACKGROUND OF THE INVENTION

1. Field

The present invention relates to apparatus, systems and methods for preparing and installing modular pavement. The present invention more particularly relates to improved prefabricated, modular paving apparatus, systems and methods for preparing and installing same.

2. Discussion of Related Art

It is known to join adjacent modular pavement slabs to enable load transfer between the slabs. For example, U.S. Pat. No. 5,586,834 to Tsuji ("Tsuji") discloses a simple arrangement in which a reinforcing bar (5) is installed by centering it between long and short cavities (4, 9) of respective adjoining slabs. The bar (5) may be centered by pulling a flexible hauling member (13) through a guide passage (11) and horizontal hole (9) in the short cavity slab to move the bar (5) from the long cavity (4). Once the bar (5) is centered between the slabs, the long and short cavities may be grouted by a filler charging device connected via apertures adjacent the ends of the cavities. (Tsuji, FIG. 1 and cols. 3-4)

Existing systems may, however, lead to haphazard and imprecise assembly, as well as ineffective load transfer. It is desirable to provide apparatus, systems and methods for improved coupling of adjacent modular pavement slabs.

This background discussion is intended to provide information related to the present invention which is not necessarily prior art.

BRIEF SUMMARY OF THE INVENTION

Embodiments of the present invention address problems and limitations of the prior art by providing a pavement apparatus and system configured specifically to improve the quality and ease of positioning coupling means. Embodiments of the present invention further provide improved load distribution and design efficiency through configurations—including patterns and locations—of a plurality of coupling means distributed across at least one pavement apparatus.

According to one aspect of the present invention, a system for coupling a pavement slab to an adjacent receiving structure is provided. The system includes a substantially horizontal first cavity in the slab terminating along a side of the slab. The system also includes a substantially horizontal second cavity in the receiving structure terminating along a side of the receiving structure, the side of the receiving structure being adjacent to the side of the slab in an installed configuration. The system also includes a coupling rod having a first portion received within the first cavity and a second portion received within the second cavity. The system also includes a spacer having a seating surface configured to receive a lower surface of the coupling rod and an alignment surface for positioning in alignment with a landmark segment of the slab.

A second aspect of the present invention concerns a pavement slab for coupling to a substantially identical adjacent structure. The slab includes opposite first and second faces extending in a first direction, the first direction being parallel to a direction of load progression. The slab also includes opposite third and fourth faces extending in a second direction substantially orthogonal to the first direction. The slab also includes a first plurality of cavities configured to receive coupling rods, each of such cavities having a length defined in the second direction and a diameter defined orthogonally to the second direction, with each of such cavities terminating in one of the first and second faces. The slab also includes a second plurality of cavities configured to receive coupling rods, each such cavity having a length defined in the first direction and a diameter defined orthogonally to the first direction, and each such cavity terminating in one of the third and fourth faces. Preferably, each of the first plurality of cavities is at least as distant from the third and fourth faces in the first direction as the length of a longest cavity of the second plurality of cavities.

In regard to a third aspect of the present invention, a method for installing adjacent pavement slabs method is provided. The method includes aligning a plurality of cavities spaced along a side of a first slab with a corresponding plurality of cavities spaced along a side of a receiving structure. The method further includes adjusting the position of a plurality of coupling rods, each of the plurality of coupling rods being at least partially within one of the plurality of cavities and at least partially within one of the corresponding plurality of cavities. Preferably, the adjustment of the position of each of the plurality of coupling rods is effected using at least one spacer for each of the plurality of coupling rods. Further, each spacer preferably includes a seating surface configured to receive a lower surface of the coupling rod and an alignment surface for positioning in alignment with a landmark segment of the first slab.

In regard to a fourth aspect of the present invention, a system is provided for coupling a pavement slab to an adjacent receiving structure. The system includes a substantially horizontal first cavity in the slab terminating along a side of the slab and a substantially horizontal second cavity in the receiving structure terminating along a side of the receiving structure, the side of the receiving structure being positioned adjacent to the side of the slab. The system also includes a coupling rod having a first portion received within the first cavity and a second portion received within the second cavity in an installed, extended configuration. The system also includes a first passage positioned along a lateral axis at least partially above a first end of the coupling rod in the installed, extended configuration. The system also includes a second passage positioned along a lateral axis at least partially above a second end of the coupling rod in the installed, extended configuration. The system further includes a third passage positioned along a lateral axis at least partially above the first end of the coupling rod in an uninstalled, retracted configuration. The first cavity is preferably configured to accommodate substantially the entire length of the coupling rod and the second cavity is configured to accommodate approximately one half of the entire length of the coupling rod.

This summary is provided to introduce a selection of concepts in a simplified form. These concepts are further described below in the detailed description of the preferred embodiments.

This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWING FIGURES

Preferred embodiments of the present invention are described in detail below with reference to the attached drawing figures, wherein.

Figure 23:
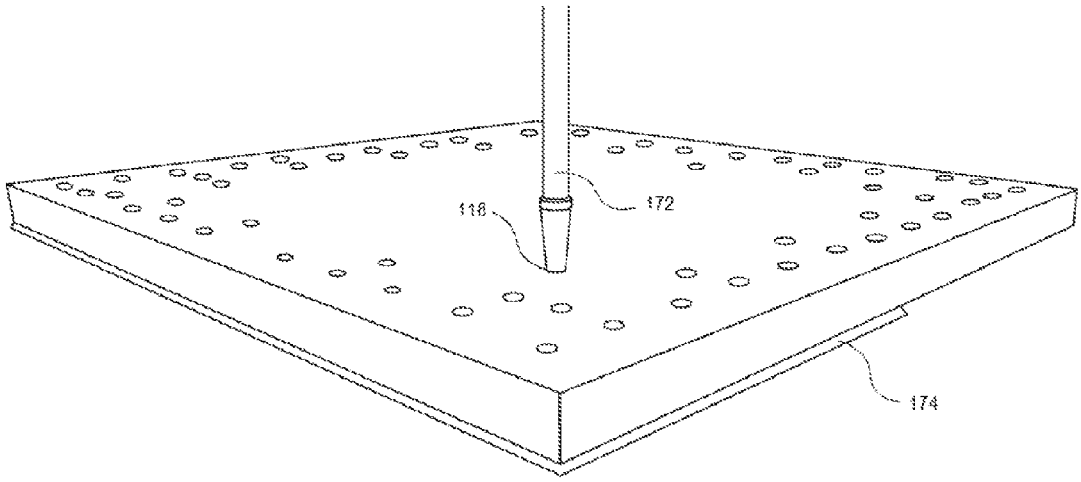
Figure 24:
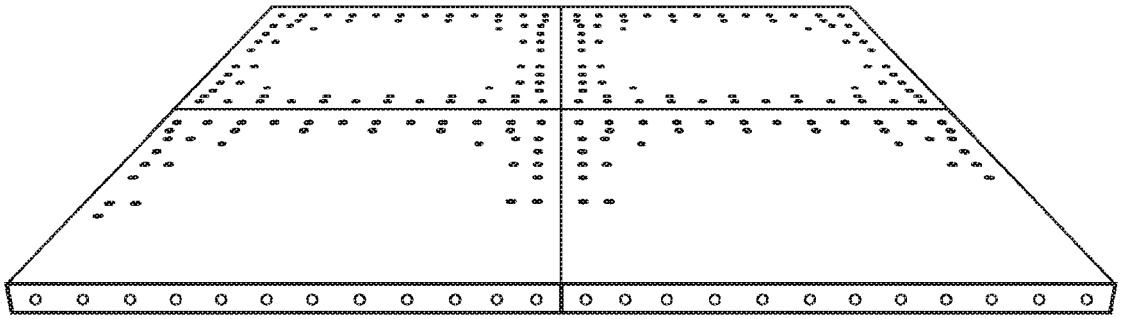

FIG. 23 is an elevated schematic view of a slab during addition of an underlying grout layer using a grouting nozzle pumping grout through a receiver port and grouting port (not shown); and FIG. 24 is an elevated schematic view of four slabs midway through finishing installation steps, namely illustrating partial completion of patching remaining surface holes (such as upper segments of passages and receiver ports) using the grouting nozzle (not shown).

The drawing figures do not limit the present invention to the specific embodiments disclosed and described herein.

The drawings are not necessarily to scale, emphasis instead being placed upon clearly illustrating the principles of the preferred embodiments.

DETAILED DESCRIPTION OF THE PREFERRED EMBODIMENTS

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

Figure 1:
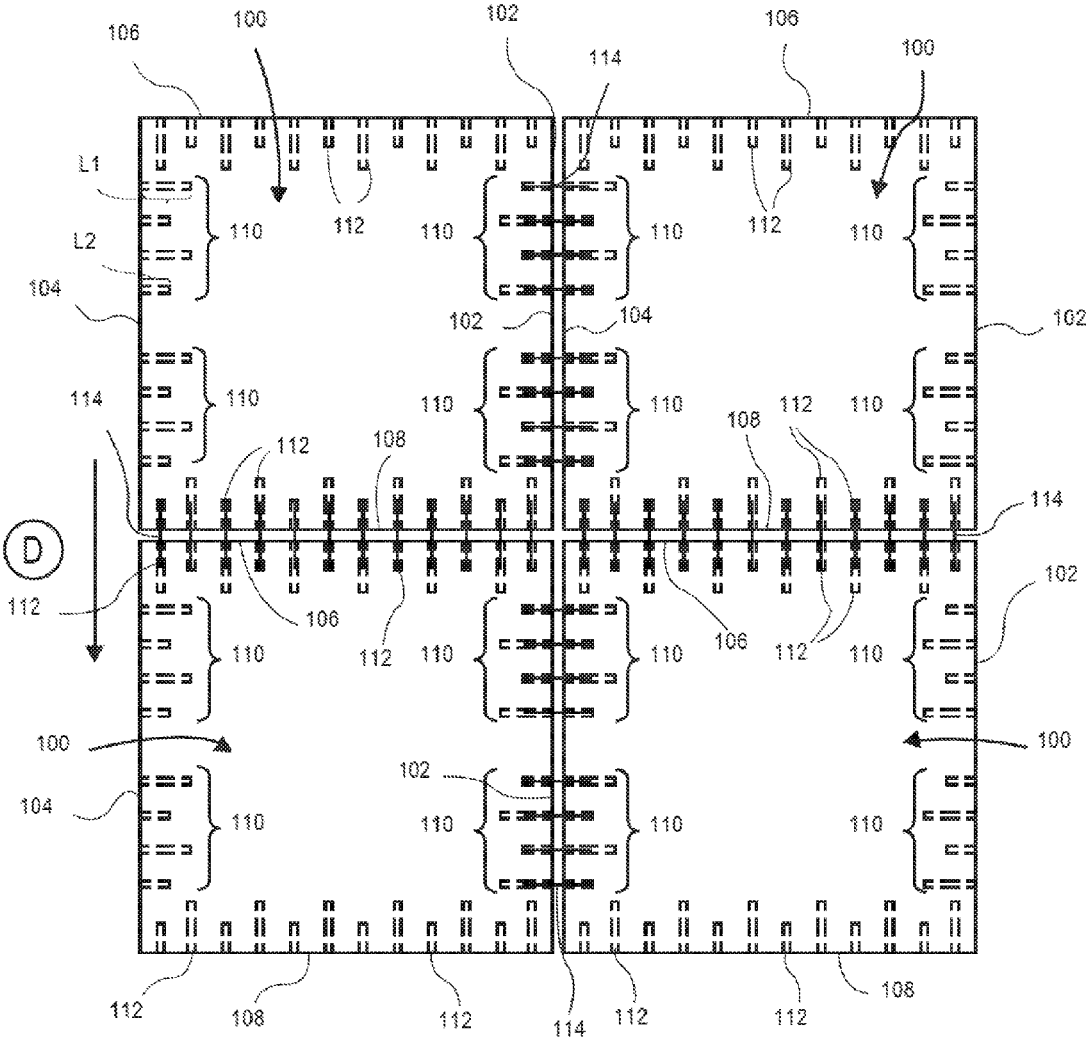
FIG. 1 is a top schematic view of a modular pavement system according to an embodiment of the present inventive concept and indicating a direction of anticipated load progression, the system including four slabs each having first and second pluralities of cavities and coupling rods in an, extended installed configuration.

FIG. 1 illustrates a system of four pavement slabs 100, with each such slab 100 being coupled to two neighboring slabs 100. Each slab 100 includes opposite first and second faces 102, 104 extending in a first direction D generally corresponding to a direction of anticipated load progression that, in the illustrated embodiment, is the direction of anticipated travel for vehicles. Each slab 100 also includes opposite third and fourth faces 106, 108 extending in a second direction generally perpendicular to the first direction D.

Each slab 100 has four groupings of cavities belonging to a first plurality of cavities 110—two groupings along each of the first and second faces 102, 104. In the depicted embodiment, rotating the groupings along the first face 102 one hundred eighty degrees (180°) generates the configuration seen along the second face 104. The first plurality of cavities 110 alternate between two lengths L1, L2 defined in the second direction and have a uniform diameter defined orthogonally to the second direction.

Each slab also has a second plurality of cavities 112 along the third and fourth faces 106, 108. The second plurality of cavities 112 are evenly spaced along substantially the entire lengths of the third and fourth faces 106, 108—preferably about twelve inches (12") center-to-center—and also alternate between two lengths L1, L2, where such lengths are defined in the first direction D. The diameters of cavities 112 are defined orthogonally to the first direction D.

FIG. 1 also illustrates coupling rods 114 along the inner faces of slabs 100 in an extended, installed configuration.

Preferably, cavities having length L1 (that is long, male cavities) are configured to accommodate at least the entire length of a coupling rod, for example while in an uninstalled, retracted position. Cavities having length L2 are preferably configured to accommodate at least approximately half the entire length of a coupling rod. Enabling a fully retracted position using cavities of length L1 enables an installer to drop a slab 100 into place flush against adjacent structures prior to extending coupling rods for engagement and installation. This provides for easier installation, removal and replacement of slabs adjacent surrounding structures, without the requirement of disturbing or moving the surrounding structures. Embodiments including only cavities of shorter length L2 may lack this advantage. Cavities 110 are evenly spaced from one another within each grouping of four, preferably about twelve inches (12") center-to-center, with some additional space between groupings and along the edges of the slabs 100.

Preferably, cavities 110, 112 are cylindrical and have diameters determined according to the following formula:

$$d_{cav}\ \text{(inches)} = 1 + \frac{\text{Distance between center of cavity to top surface of slab (inches)}}{8}$$

Preferably, the diameters of the coupling rods 114 are determined by taking the value for cavity diameter ($d_{cav}$) determined by the above formula and subtracting one inch (1").

Preferably, L1 is determined by the length of the coupling rod plus the internal diameter of a third vertical passage described below, minus an inset depth sufficient to preclude environmental deterioration, typically 2" or less. Preferably, L2 is determined according to similar principles.

It is possible to perform the foregoing and other dimensional calculations in connection with varying embodiments in alternative order(s) according to known mathematical principles, and/or to vary same according to factors and considerations commonly considered in similar design applications, without departing from the spirit of the present inventive concept.

In the illustrated embodiment, no cavity 110 is closer to a third face 106 or a fourth face 108 than a distance equal to the length of the longest cavity of the second plurality of cavities 112 (in this case L1) and, in fact, each is removed from such faces 106, 108 by an even greater distance. It is foreseen that yet more distance may be added to this separation without departing from the spirit of the present inventive concept (i.e., at least about twice the length of the longest cavity of the second plurality of cavities 112, or two times L1). This separation improves the integrity of the slabs 100 by ensuring there is significant pavement material between adjacent cavities. Moreover, in embodiments where cavities 110, 112 are located at approximately the same depth within the slabs 100, this separation ensures no two cavities will intersect, which could interfere with structural integrity and/or grouting/finishing processes such as those described herein.

The cavities illustrated in FIG. 1 alternate between long and short lengths L1, L2, generally corresponding respectively to male and female functionality in receiving coupling rods 114 between them. It is foreseen that embodiments may alternatively employ a first slab face having cavities exclusively of uniform, male, length and a second, opposite slab face having cavities exclusively of uniform, female, length, without departing from the spirit of the present inventive concept. It is further foreseen that embodiments may alternatively employ a slab face with approximately half of its cavities forming a first grouping of adjacent cavities of uniform, male, length and the remaining cavities forming a second grouping of adjacent cavities of uniform, female, length, without departing from the spirit of the present inventive concept. In the embodiments described in the preceding sentence, the cavities in each grouping are preferably evenly spaced from one another, with the first grouping preferably occupying approximately one half the length of the face and the second grouping occupying approximately the second half of the length of the face.

In the embodiment illustrated in FIG. 1, there are fifty percent (50%) more cavities 112 and corresponding coupling rods 114 than there are cavities 110 with corresponding coupling rods 114. This design is optimized in this manner to respond to predominant load progression in the first direction D, which places additional stresses on the interfaces between faces 106, 108 that are not felt to the same degree at the interfaces between faces 102, 104. However, it is envisioned that other groupings, spacing, cavity lengths and diameters and the like may be utilized without departing from the spirit of the present inventive concept. For example, groupings may also be used for cavities 112; for example a grouping may be located below anticipated wheel paths in the case of load progression involving vehicle travel.

Cavities 110, 112 (and also the substantially vertical passages discussed below that are formed integrally with and/or intersect with cavities 110, 112) may be hollows formed within slabs 100, or may be fabricated from material(s) suitable to be embedded into and/or bonded to, concrete and other cementitious materials. Where fabricated, such material(s) may be molded and placed into a concrete precast form before the main body of the slab 100 itself is poured or formed around them. Typically, suitable materials include steel (both plain and with various coatings and surface treatments), fiberglass, and carbon fiber.

Figure 2:
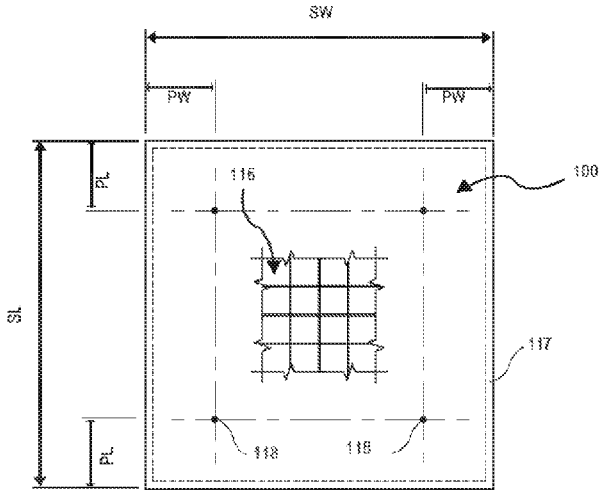
FIG. 2 is a top schematic view of a slab of FIG. 1 having a middle segment of a top surface of the slab removed to reveal a portion of an exemplary internal reinforcement grid.
Figure 3:
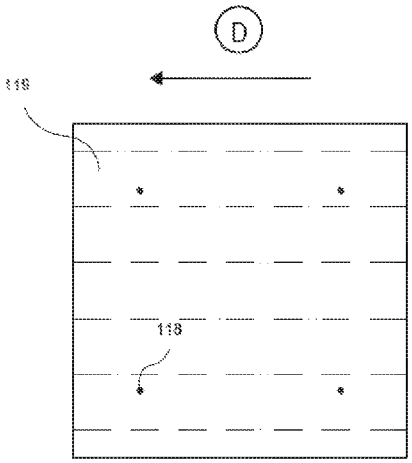
FIG. 3 is a top view of the slab of FIG. 2 illustrating a plurality of prestress tendons and indicating a direction of anticipated load progression.
Figure 4:
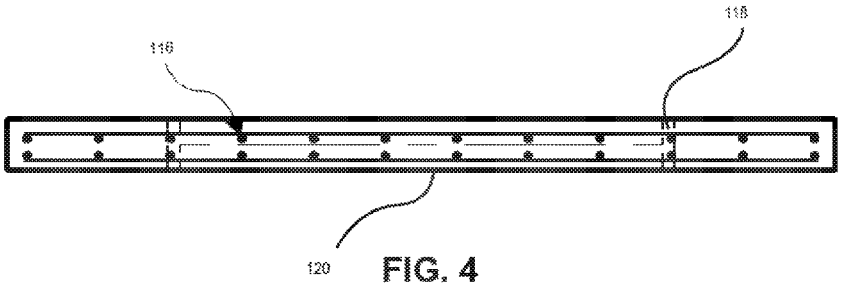
FIG. 4 is a sectional side view taken through the middle segment of the slab of FIG. 2 and further illustrating the exemplary internal reinforcement grid and relative positioning of receiver ports.
Figure 5:
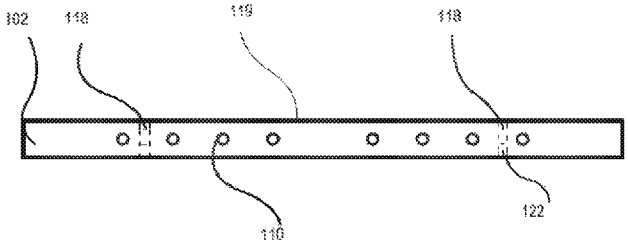
FIG. 5 is a side view of the slab of FIG. 2 illustrating a first face including two groupings of a first plurality of cavities and relative positioning of receiver ports.

The main body of the slabs 100 may be composed of reinforced (or unreinforced) geopolymer, plastic, hollow-core, fiberglass, carbon fiber, foamed concrete, pervious concrete or similar material, or other suitable materials. The slabs 100 may further include an internal reinforcement system such as, for example, a series of alternating layers of steel rebar or fiberglass or carbon fiber reinforcement materials embedded within the concrete. The internal reinforcement system improves the ductility and/or tensile strength of the paving apparatus. For example, FIG. 2 illustrates an example of an internal reinforcement grid 116 comprising a lattice of epoxy-coated rebar embedded within the slabs 100. The slabs 100 may further include post tension tendons or strands (see FIG. 3), which may slow the development of cracks along the main body of the slabs 100. Still further, the upper periphery of the slabs 100 may be shaped to include a chamfer 117, as generally illustrated in FIG. 2.

Referring more generally to FIGS. 2-5, the slabs 100 further include receiver ports 118 having receiver lugs (not shown) embedded therein. The receiver lugs may be secured to the internal reinforcement grid 116 and/or be sufficiently embedded in the main body of the slabs 100 to permit lifting thereby without damaging the integrity of the main body of the slabs 100. Alternatively, the receiver lugs may include flanges or the like positioned along portions of a bottom 120 of the slab, permitting the force of lifting to be distributed thereacross. The receiver lugs are configured for attachment to a crane or hoist for lifting (see FIG. 14).

Receiver ports 118 are spaced across a top surface 119 of each slab 100 to enable balanced lifting. As illustrated, for example, a slab 100 having a length (SL) and width (SW) has four receiver ports 118. Each receiver port 118 is separated from its adjacent corner along a length axis by twenty percent (20%) of the total length of the slab (PL), and likewise is separated from its adjacent corner along a width axis by twenty percent (20%) of the total width of the slab (PW). Receiver ports 118 may further provide fluid communication with a bottom 120 of the slab 100 via a grouting port 122. The grouting port 122 may include a hollow sheath centered on the lower terminus of the pickup (e.g., a PVC sheath). It is foreseen that the grouting ports 122 may comprise other materials, or may simply be defined by the main body of the slabs 100 themselves, without departing from the spirit of the present inventive concept.

Exemplary receiver ports useful with embodiments of the present invention are described in United States Patent Publication No. 20150010354A1 to Sylvester, filed Sep. 4, 2014 (the "'354 Publication"), which is hereby incorporated herein by reference in its entirety. Exemplary ports described therein may be referred to as "access ports." For example, it is foreseen that such receiver ports may provide access to additional components, such as sensors, in accordance with the teachings of the '354 Publication, without departing from the spirit of the present inventive concept. It is still further foreseen that alternative means for moving and securing coupling rods in a lateral direction may be employed with embodiments described herein, again in accordance with the teachings of the '354 Publication, without departing from the spirit of the present inventive concept.

Figure 6:
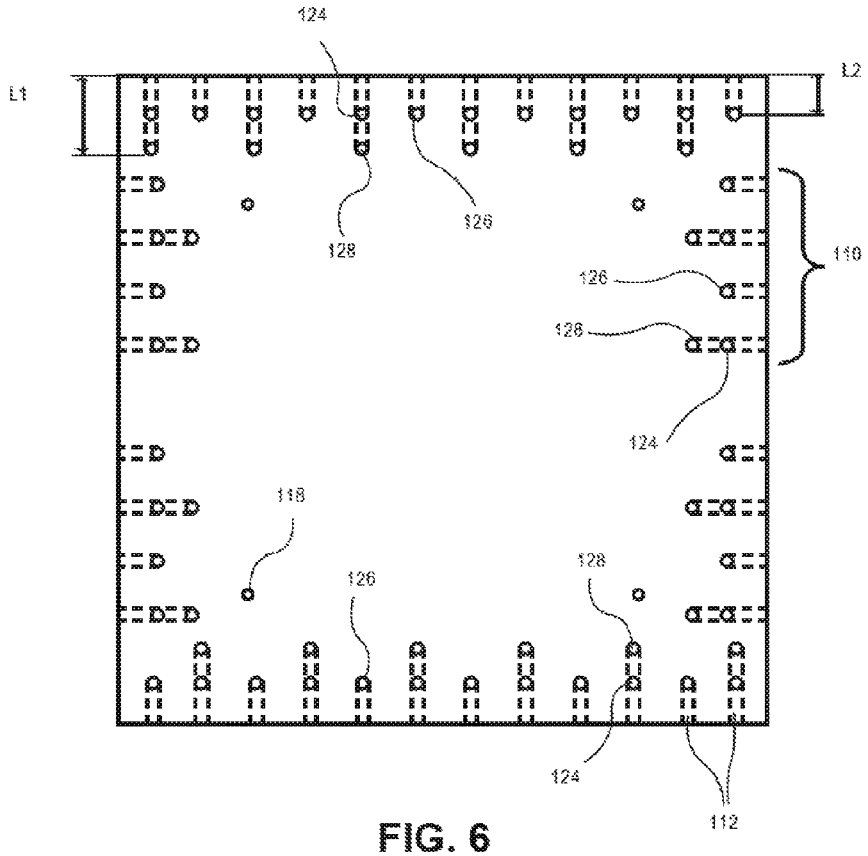
FIG. 6 is a top schematic view of a slab of FIG. 1 illustrating the first and second pluralities of cavities with intersecting substantially vertical passages.
Figure 7:
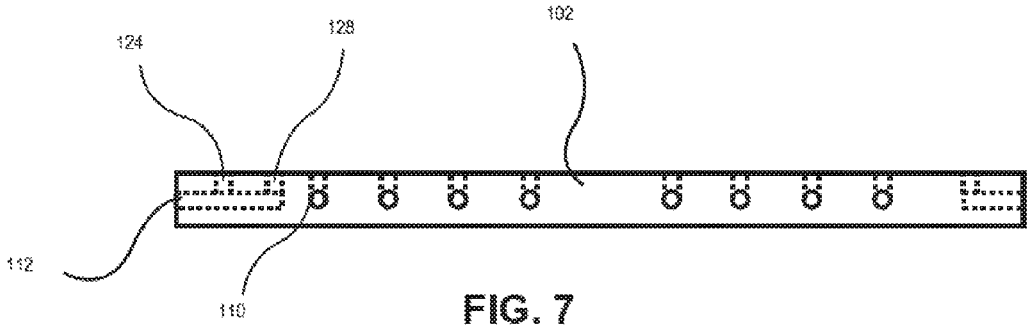
FIG. 7 is another side view of the first face of FIG. 5, additionally illustrating associated vertical passages of the two groupings of the first plurality of cavities as well as two of the second plurality of cavities (and associated vertical passages)
Figure 8:
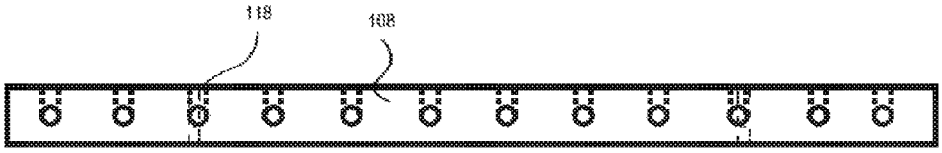
FIG. 8 is a side view of the slab of FIG. 2 illustrating a fourth face including half of the second plurality of cavities (and associated vertical passages) along with relative positioning of receiver ports.

Turning now to FIGS. 6-8, a slab 100 is illustrated in additional detail. Each of cavities 110, 112 of length L1, i.e., the longer male cavities, intersects with a first substantially vertical passage 124 nearer the edge of the slab 100. Each of cavities 110, 112 of length L2, i.e., the shorter female cavities, intersects with a second substantially vertical passage 126 near the edge of the slab 100. First and second substantially vertical passages 124, 126 assist in alignment, including by housing spacer devices (otherwise referred to as "dowel hangers" or "dowel chairs") described in additional detail below. First and second substantially vertical passages 124, 126 may also provide points of ventilation during filler or grouting processes.

Each of cavities 110, 112 of length L1, i.e., the male cavities, also intersects with a third vertical passage 128 adjacent its internal terminus. The third vertical passages 128 may assist in the extension of coupling rods 114 from male cavities. In an embodiment, a snake or pipe auger (see FIG. 17) is extended through the third vertical passage 128 to urge the coupling rod 114 in a telescoping movement into the female cavity of an adjacent slab, i.e., a cavity having length L2.

Figure 9:
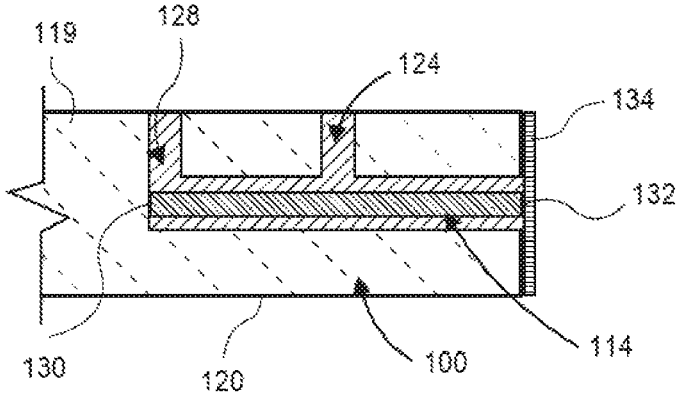
FIG. 9 is a sectional side view of a long cavity of a slab (and associated vertical passages) and a coupling rod in an uninstalled, retracted configuration.
Figure 10:
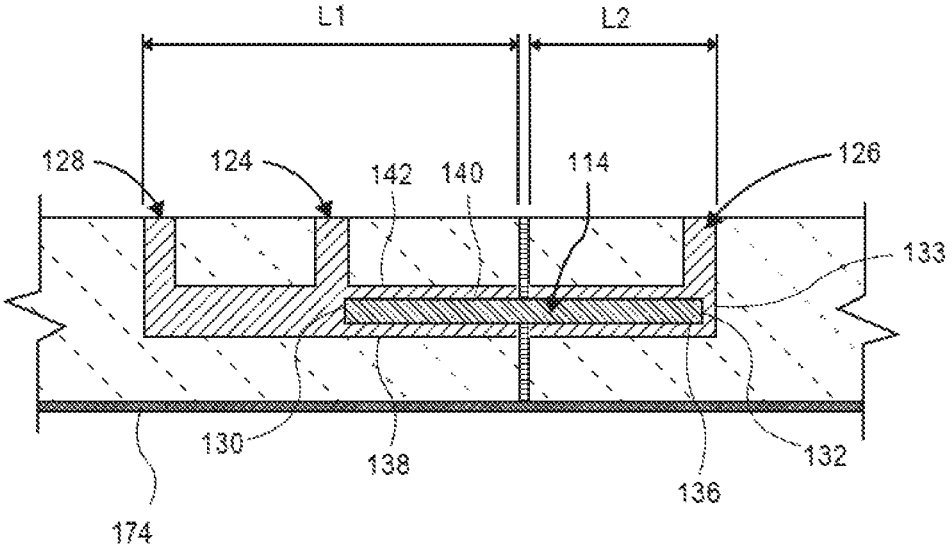
FIG. 10 is a sectional side view of a slab including an underlying grout layer, the slab having a long cavity aligned with a corresponding short cavity of an adjacent receiving structure and a coupling rod in an installed, extended configuration.

Turning now to FIGS. 9-10, a slab 100 is illustrated in additional detail sectioned through a substantially horizontal cavity housing a coupling rod 114. FIG. 9 illustrates slab 100 in an uninstalled, retracted configuration with third vertical passage 128 at least partially above an interior first end 130 of coupling rod 114. In a preferred embodiment, however, the third vertical passage 128 is only minimally above the coupling rod 114—the coupling rod 114 is instead preferably offset toward the side of the slab 100, only partly extending across the width of the third vertical passage 128. A second end 132 of the coupling rod 114 is essentially flush with the outer face of the slab 100 in the uninstalled, retracted configuration.

Figure 12:
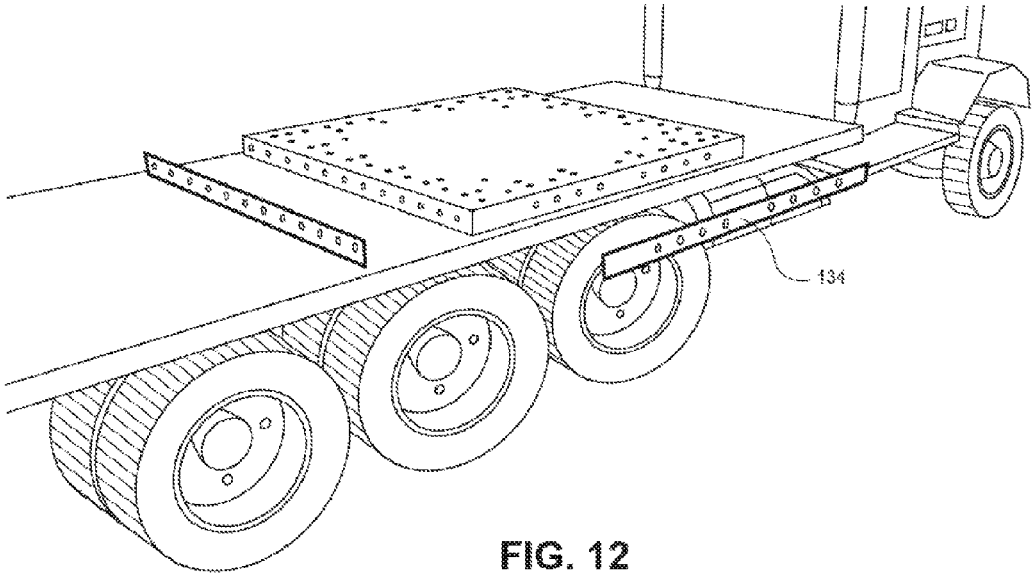
FIG. 12 is an elevated perspective view of the slab of FIG. 11 with coupling rods fully inserted and with strips of pre-cut joint filler material being prepared for application to the first and fourth faces prior to installation of the slab.

Also depicted in FIGS. 9-10 is a joint filler 134, which is preferably pre-cut and attached to the outer face of at least one of the slabs 100 prior to placing two slabs 100 next to each other for coupling, as will be described in additional detail below with reference to FIG. 12. The joint filler may comprise any material to facilitate joint sealing, force transfer, installation and/or removal of the slabs. Suitable materials include rubber, plastic, or polymer compounds, such as a recycled tire product. These materials preferably form a "compression garment" or "bumper" around the slab. They may be applied in strips as described herein to either or both of two adjacent structures or slabs, preferably prior to installation. The material can extend the full depth of the slab and joint and substantially exclude water by fitting tightly against its neighboring structures.

FIG. 10 illustrates sections of two slabs 100 having outer faces sitting essentially flush against one another. FIG. 10 also illustrates a coupling rod 114 extended laterally into an installed position, with first end 130 being at least partially below first vertical passage 124, and second end 132 being at least partially below second vertical passage 126 and near a stopping surface 133. While passages 124, 126, 128 are preferably vertical as illustrated, it is foreseen that they may be oriented other than substantially vertically without departing from the spirit of the present inventive concept. For example, passage 128 may permit access to a pipe auger, and passages 124, 126 may permit access to spacer devices, even if oriented other than substantially orthogonal to the substantially horizontal top surfaces 119 of the slabs 100.

FIGS. 9-10 illustrate the coupling rod 114 as centered within the male and female cavities, though in practice such centering preferably results, in the present inventive concept, from using spacers substantially according to the description below. The illustrated coupling rod 114 is substantially cylindrical, as are the surrounding/enclosing cavities, and the coupling rod 114 has been adjusted for an optimal pre-determined separation—in this case approximately 12.77 mm or about half an inch (0.5")—between a lower surface 136 of the coupling rod 114 and a lower inner surface 138 of the cavity. Essentially the same separation is also seen between an upper surface 140 of the coupling rod 114 and an upper inner surface 142 of the cavity, and is preferably also present around substantially the entire perimeter of the coupling rod 114.

Figure 11:
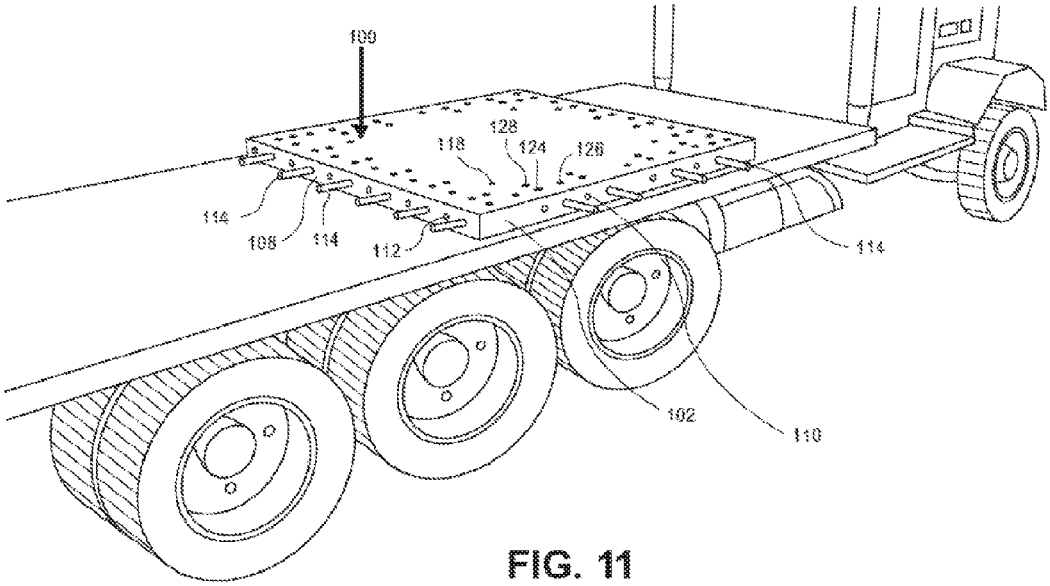
FIG. 11 is an elevated perspective view of a slab according to an embodiment of the present inventive concept lying on a truck bed for delivery and having coupling rods partially inserted into male (long) cavities along first and fourth faces of the slab.

Turning to FIGS. 11-24, a method of installing pavements slabs 100 is described by progressive illustration. FIG. 11 illustrates a plurality of coupling rods 114 as they are being slid into male cavities 110, 112 along faces 102, 108 of a slab 100. FIG. 12 illustrates applying pre-cut joint filler material 134—which includes apertures aligned with cavities 110, 112 to permit movement of coupling rods 114 therethrough—to faces 102, 108. The foregoing insertion and attachment steps are shown occurring on the bed of a truck, and preferably on a truck that includes a mobile crane, but it is envisioned that such steps may occur in a variety of locations, for example during fabrication and prior to transport to the installation site, without departing from the spirit of the present inventive concept.

Figure 13:
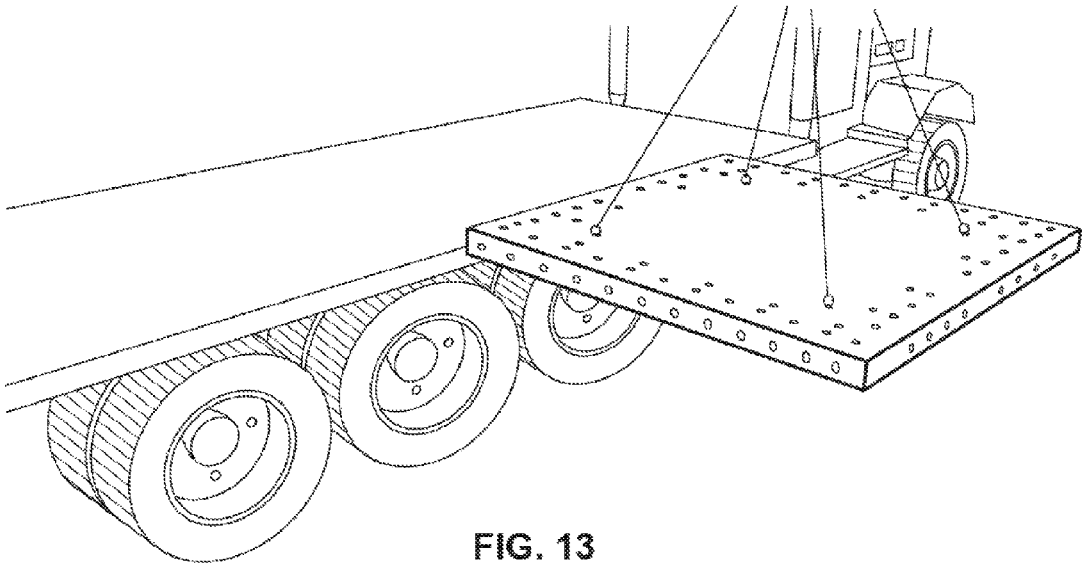
FIGS. 13-14 are elevated perspective views of the slab of FIG. 11 in the process of being lifted and re-positioned by a crane from the truck bed via hauling cables connected to lift lugs (not shown) embedded within receiver ports of the slab.
Figure 14:
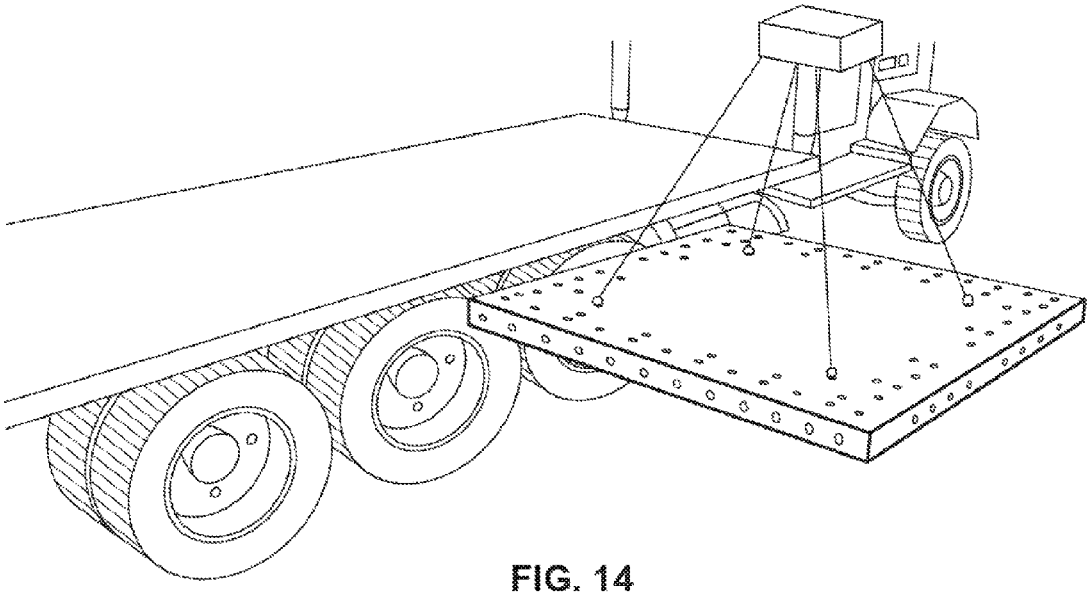
Figure 15:
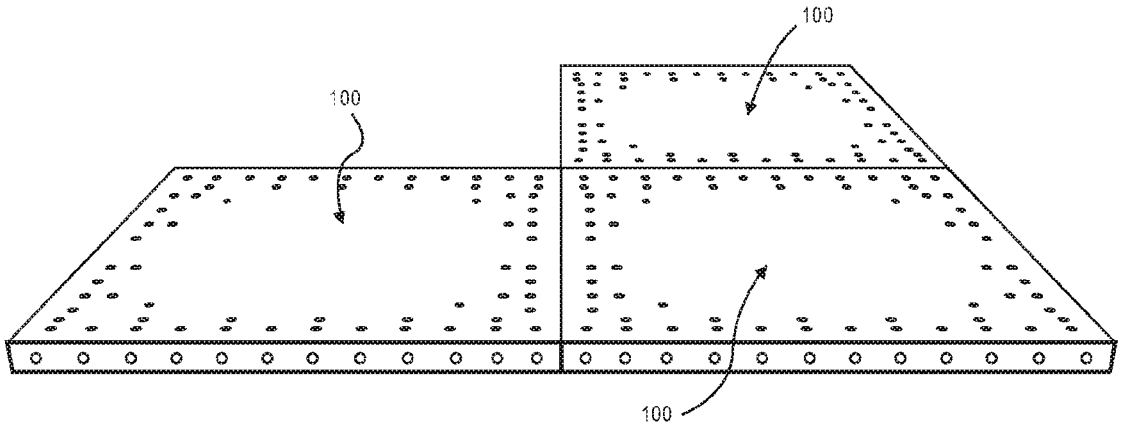
FIG. 15 is an elevated schematic view of three slabs aligned for installation.

FIGS. 13-14 illustrate attaching a crane to receiver ports 118 and lifting the slab 100 toward at least one receiving structure for alignment therewith and positioning adjacent thereto, preferably on a prepared grade surface. FIG. 15 illustrates three aligned and adjacent slabs 100 in position for beginning the coupling process.

Figure 16:
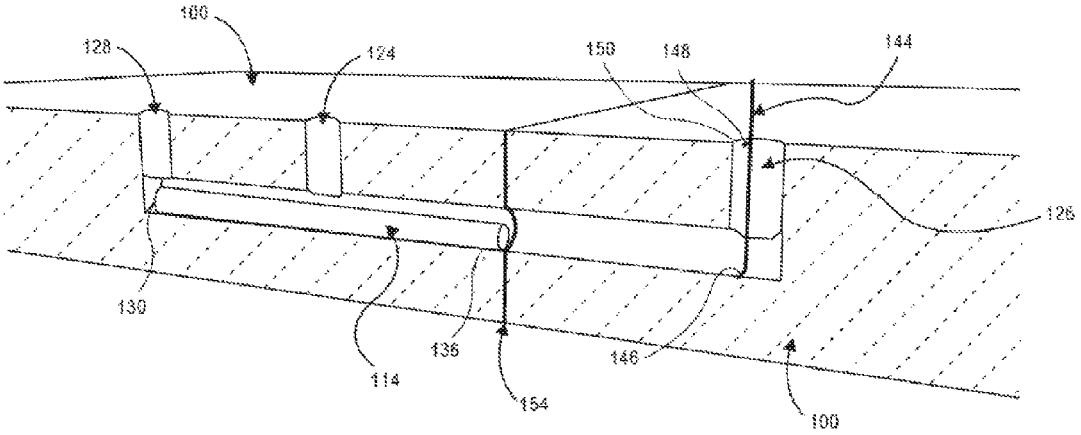
FIG. 16 is an elevated side sectional view of adjacent substantially identical slabs, the left slab including a male (long) cavity being aligned with a female (short) cavity of the right slab and housing a coupling rod in an uninstalled, retracted configuration, and a passage of the right slab housing a spacer.

FIG. 16 illustrates detail from a cross-sectional view of a coupling rod 114 in retracted, uninstalled position within a male cavity, with first end 130 at least partially below third vertical passage 128. A first spacer 144, illustrated in its dowel chair embodiment, is shown inserted into second vertical passage 126 of the receiving structure (illustrated as another slab 100). Spacer 144 includes a seating surface 146 that is partially curved and configured to receive lower surface 136 of the coupling rod 114. Spacer 144 also includes an alignment surface 148 comprising a projection that is positioned just below the top of second vertical passage 126. In this configuration, the portion of the top surface 119 of the slab 100 that is adjacent the second vertical passage 126 serves as a landmark segment 150 of the slab 100 for alignment with spacer 144.

Figure 17:
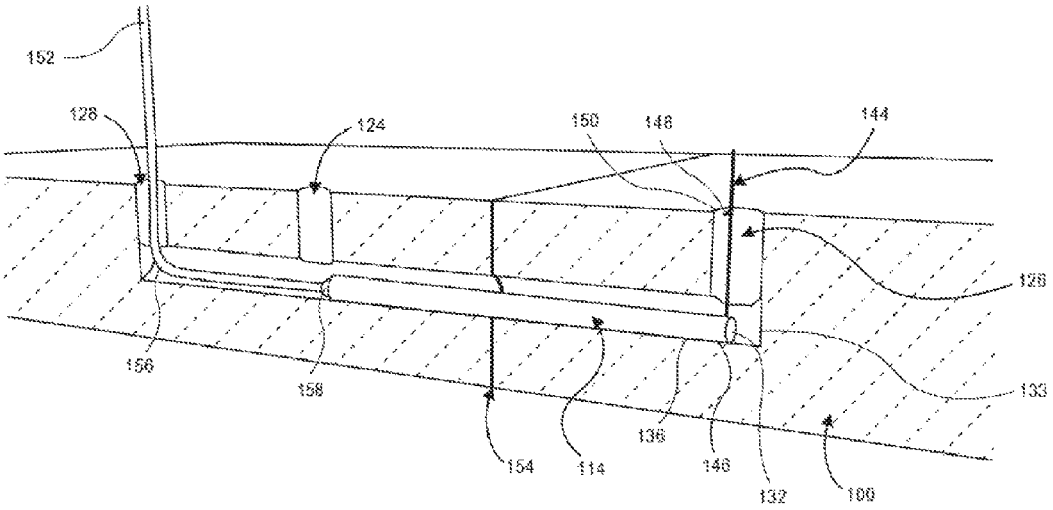
FIG. 17 is an elevated side sectional view of the slabs of FIG. 16 with the coupling rod having been extended into the female cavity of the right slab using a pipe auger such that a lower surface of the coupling rod rests on a seating surface of the spacer.

FIG. 17 illustrates a step of expressing or urging coupling rod 114 partially from the male cavity and partially into the female cavity laterally in a telescoping movement using snake or pipe auger 152. Preferably, the approximate middle of the lateral length of the coupling rod 114 is extended to an installed position centered on a seam 154 between the slabs 100, with a portion remaining inside the male cavity and another portion of roughly equivalent length inside the female cavity. In the illustrated extended position, the second end 132 of the coupling rod 114 does not quite reach stopping surface 133. Nonetheless, stopping surface 133 in this embodiment still serves to stop the coupling rod during extension by snake 152 if it is even moderately overextended beyond its final intended position for installation. Coupling rod 114 is illustrated in this instance, however, in the proper extended position for engagement with second vertical passage 126 at least partially above the second end 132 of the coupling rod 114, and with lower surface 136 of the coupling rod resting on seating surface 146 of spacer 144. It is foreseen that a coupling rod may alternatively be flush against a stopping surface in its final extended, installed configuration, which may help to ensure proper lateral positioning of the coupling rod during installation, without departing from the spirit of the present inventive concept.

Snake 152 comprises an elongated, narrow member configured for insertion through third vertical passage 128 and for pressing against end 130 to move coupling rod 114 laterally in a telescoping action for expression from the male cavity. Snake 152 preferably comprises a composite material such as a metal wire sheathed in rubber, but may also be formed of a mostly homogenous material having properties sufficient to perform the functions described herein. Snake 152 should be configured so that it is rigid enough to be capable of urging coupling rod 114 to telescope within the cavities while also exhibiting enough flex to form a shifting bend 156; the shifting bend 156 moves along the length of the snake 152 as snake 152 is pushed and pulled through the male cavity 152, such that shifting bend 156 remains at the juncture between the male cavity and third vertical passage 128. Snake 152 additionally preferably has an enlarged head 158 having a wider diameter than the main body of snake 152, shaped, for instance, to help prevent the snake 152 from deflecting away from the center of the end 130 of the coupling rod 114 and becoming lodged between coupling rod 114 and an interior surface of the male cavity.

Figure 18:
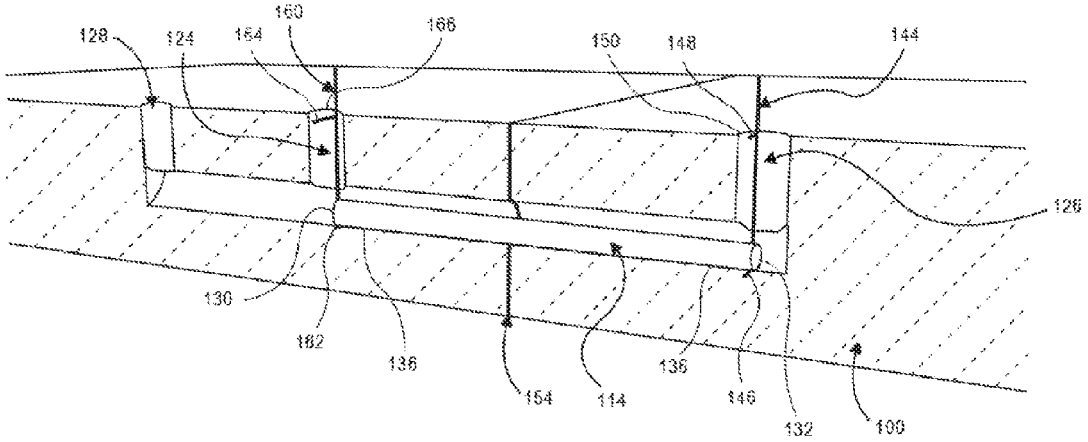
FIG. 18 is an elevated side sectional view of the slabs of FIG. 17 including an additional spacer housed in a passage of the left slab on which a first end of the coupling rod rests.

FIG. 18 illustrates a subsequent step of the method of installation described herein in which snake 152 has been removed following proper horizontal or lateral positioning of the coupling rod 114 within the cavities. A second spacer 160 illustrated as a dowel chair in this embodiment is inserted through first vertical passage 124. Second spacer 160 is constructed similarly to spacer 144, with a seating surface 162 comprising a curved projection for receiving a segment of the lower surface 136 of the coupling rod 114. Second spacer 160 also has an alignment surface 164 comprising a projection that is positioned just below the top of first vertical passage 124. In this configuration, the portion of the top surface 119 of the slab 100 that is adjacent the first vertical passage 124 serves as landmark segment 166 of male cavity-slab 100 for spacer 160.

It should be noted that the separation of seating surfaces 146, 162 from alignment surfaces 148, 164 along the rigid spacers 144, 160 is specifically configured for centering the coupling rod 114 vertically within the cavities by taking into account the depth of the passages below the landmark segments 150, 166, and of the diameters of the cavities and the coupling rod 114, in a manner apparent to one of ordinary skill in the art upon reviewing the Figures. In a preferred embodiment, the centers of the cavities are positioned at approximately the vertical midpoint of the slabs. The spacers 144, 160 may be aligned to achieve a predetermined degree of separation by manual manipulation (i.e., pulling the spacers up by hand in a substantially vertical direction) and/or manipulation using robotic or machine-assisted means.

It is also foreseen that other types of spacers may be employed for optimizing separation of coupling rods from cavities, without departing from the spirit of the present inventive concept. For example, a spacer may have a seating surface of greater surface area than the projections illustrated in FIGS. 11-24 and/or that is configured to receive a more permanent and/or greater load from the coupling rod. Such a spacer may also comprise an alignment surface configured for alignment with a different landmark segment, for example with a lower inner surface of one or both cavities, and that may also be configured to bear a load received from the coupling rod by the spacer along the seating surface. Such a spacer may also perform adjustment of the coupling rod by insertion through a different orifice or passage, for example by insertion through seam 154 between the slabs 100. Such a spacer may still further be aligned with the coupling rod and/or landmark segment by "feel"—such as by feeling for a position in which the alignment surface and/or seating surface settle into proper contact relationship(s) respectively with the landmark segment and/or coupling rod—as well as or as an alternative to, visual alignment/adjustment, without departing from the spirit of the present inventive concept. Spacers may also employ various projections including notches or other structures as a part of their alignment surfaces, preferably where such structures are configured to be complementary with and to engage a structure of the landmark segment for purposes of resting the spacer on the landmark segment. An exemplary projection includes a nib 174 is illustrated in FIG. 22, it being understood that the portion of the landmark segment 166 that receives the nib 174 is preferably formed with a notch shaped to substantially complement the shape of nib 174. A nib may alternatively be formed in the landmark segment and the receiving notch in the projection without departing from the spirit of the present inventive concept. Moreover, it is foreseen that alternative spacers may be inserted into horizontal cavities at pre-determined locations, and may therefore present seating surfaces in proper locations within such cavities so that the step(s) of adjusting the coupling rods may merely involve navigating the coupling rods into position to rest on such seating surfaces. Such adjustment(s) may additionally require lateral manipulation to ensure centering the coupling rods on the seam. In any case, it is preferable that such degrees of separation as are described herein be pre-determined, thus requiring minimal measurement and calculation "on site"; provided that it is foreseen that the seating and alignment surfaces of particular embodiments may be adjustable to suit on site conditions without departing from the spirit of the present inventive concept.

Figure 19:
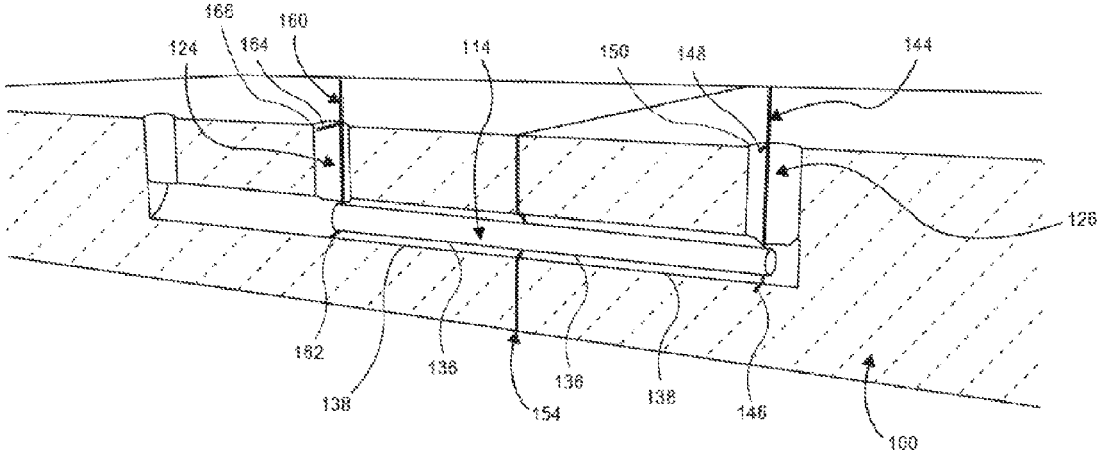
FIG. 19 is an elevated side sectional view of the slabs of FIG. 18 illustrating the coupling rod being adjusted using the spacers.

Spacers 144, 160 are illustrated in FIG. 19 after adjustment of the coupling rod 114, namely after the rod 114 is manipulated—i.e., through lifting the spacers 144, 160 until alignment surfaces 148, 164 are level with landmark segments 150, 166—so that coupling rod 114 is vertically centered within male and female cavities. In this preferred embodiment, the separation between the outer cylindrical surface of coupling rod 114 and the inner cylindrical surface of the cavities is ideally 12.7 mm all around.

To enable uniform separation from all portions of the inner surface of a cylindrical cavity, it is foreseen that the spacer may employ additional seating surfaces for receiving side surface(s) of coupling rods, and corresponding alignment surfaces for toward-and-away adjustment (from the perspective of FIG. 10) of the spacers and coupling rods (i.e., along a z-axis).

As an alternative to employing such additional seating surfaces and alignment surfaces to achieve proper separation from the cavity along the sides of the coupling rod, it is foreseen that a seating surface intended to aid in adjustment along the y- or vertical-axis may also be used to aid in adjustment and separation along the z-axis. For example, seating surfaces of embodiments of the dowel chair disclosed herein include a projection 146. This projection may alternatively be formed to comprise a first segment along its middle configured to receive and hold the lower surface 136 of the coupling rod 114, and may also comprise second and third segments on opposite sides of the first middle segment. The second and third segments may be spring-loaded or similarly biased for extension away from one another and toward opposite sides of the surrounding cavity. The length of extension of the second and third segments may be adjusted so that when the spacer's seating surface projection is raised vertically to the pre-determined height for proper vertical (y-axis) separation within the cavity as described in detail elsewhere herein, it also holds the coupling rod 114 in a center of the cavity along a z-axis. The collapsible nature of the second and third segments of the projection may further assist the installer when attempting to lower the spacer below the pre-determined height for vertical separation, for example in order to initially catch and seat the coupling rod prior to vertical alignment.

Returning to FIG. 19, after the vertical alignment step, alignment surfaces 148, 164 have additionally been brought into contact (not shown) with and made to rest upon portions of landmark segments 150, 166, so that spacers 144, 160 may be released by installers without dropping the coupling rod 114 out of its vertically-centered position. This resting relationship is not clearly discernable from FIG. 19, but will be enabled for one of ordinary skill in the art upon review of FIG. 19 and consideration of the general concept of how a projection might be brought to rest on a flat (top) surface. For example, alignment surfaces 148, 164 may comprise spring-loaded projections biased for extension beyond the perimeter of vertical passages 126, 124, and which extend outward to rest on the substantially horizontal landmark segments 150, 166 when the spacers 144, 160 are raised to the pre-determined, aligned height, i.e., slightly above the top surface of the slab.

Figure 20:
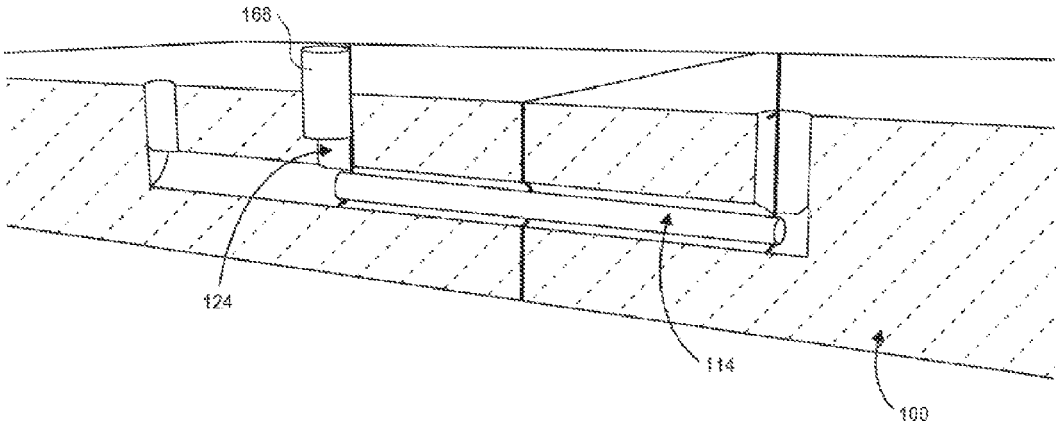
FIG. 20 is an elevated side sectional view of the slabs of FIG. 19 including a plug inserted into the passage of the left slab.

FIG. 20 illustrates the insertion of a plug 168 into first vertical passage 124 without substantially disturbing the vertical position of coupling rod 114 within the male and female cavities. Preferably, the position and upper portion of the body of spacer 160 (and 144) is configured to conform to the walls of passages 124, 126 in an installed configuration, such that insertion of plug 168 minimally disturbs the position of coupling rod 114 upon insertion.

Figure 21:
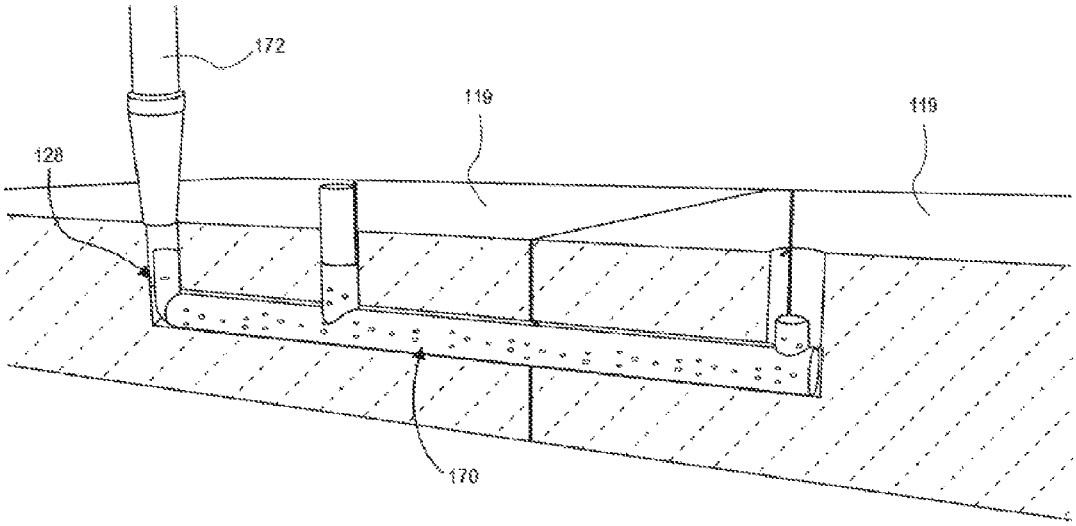
FIG. 21 is an elevated side sectional view of the slabs of FIG. 20 illustrating the grouting of portions of the horizontal cavities and passages of the left and right slabs using a grouting nozzle.
Figure 22:
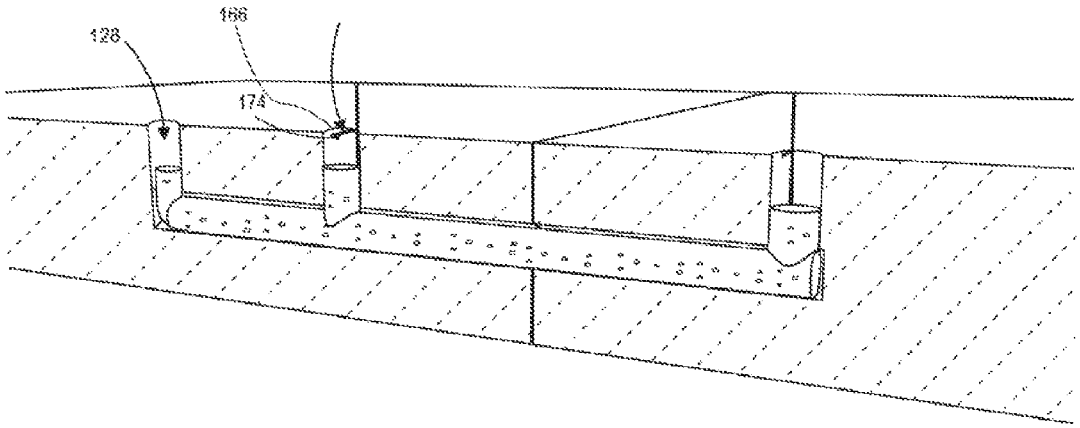
FIG. 22 is an elevated side sectional view of the slabs of FIG. 21 after removal of the plug and grouting nozzle.

FIG. 21 illustrates injection of filler or grout 170 into male and female cavities using a grouting line/nozzle 172 inserted into third vertical passage 128. Filler 170 substantially occupies the space around the coupling rod 114 in the male and female cavities following completion of the grouting process. To complete the grouting process, plug 168 is inserted into vertical passage 124 (i.e., the "proof port") and grout is pumped through the male cavity and into the female cavity until grout pushes up through vertical passage 126 (i.e., the "exhaust port") to a point about two inches (2") from the top surface 119. Vertical passage 126 is then plugged and grouting is pumped until it pushes up through vertical passage 124 to a point about two inches (2") from the top surface 119. FIG. 22 illustrates the system of FIG. 21 with the grouting line/nozzle 172 removed from the third vertical passage 128 following completion of this grouting process.

It is foreseen that filler other than grout may be used without departing from the spirit of the present inventive concept; provided, however, that it is preferred to use a grout such as one comprising grease and epoxy or a similar mixture that provides a distributed, non-permanent (i.e., more easily removable than the material making up main body of the slab 100) contact area in support of the coupling rod 114.

It is foreseen that the steps for positional adjustment of coupling rods within male and female cavities, and for grouting such cavities, will be repeated for all of the cavities 110, 112 (see FIG. 1) in many installation scenarios. FIG. 23 illustrates an additional finishing step, preferably undertaken after all such cavities have been grouted. This additional finishing step includes inserting grouting line/nozzle 172 into at least one of the receiver ports 118 to inject grout or other filler through receiver ports 118, through underlying grouting ports 122, and across bottom surfaces 120 of slabs 100 to generate one or more underlying grout layer(s) 174. Where such underlying grout layer(s) 174 are formed prior to grouting cavities 110, 112, grout layer(s) 174 may more easily adjust the leveling of the slabs 100 to bring them to a final installed height and/or grade and/or otherwise assist in optimizing the interfaces between the slab bottoms 120 and the ground. Such an ordering of grouting steps may be preferred in certain installation settings, such as where the grade is particularly difficult. In most applications, however, it is preferable that cavities 110, 112 are grouted first to preserve the relative position of the slabs 100, followed by application of the grout layer(s) 174 for long term stability.

FIG. 24 illustrates yet another finishing step in which the grouting line/nozzle (not shown) has been used to patch some of the remaining surface holes (such as upper segments of vertical passages and receiver ports), it being understood that those remaining visible in FIG. 24 are preferably also filled prior to completing installation.

Although the above description presents features of preferred embodiments of the present invention, other preferred embodiments may also be created in keeping with the principles of the invention. Furthermore, these other preferred embodiments may in some instances be realized through a combination of features compatible for use together despite having been presented independently in the above description.

The preferred forms of the invention described above are to be used as illustration only and should not be utilized in a limiting sense in interpreting the scope of the present invention. Obvious modifications to the exemplary embodiments, as hereinabove set forth, could be readily made by those skilled in the art without departing from the spirit of the present invention.

In this description, references to "one embodiment", "an embodiment", or "embodiments" mean that the feature or features referred to are included in at least one embodiment of the invention. Separate references to "one embodiment", "an embodiment", or "embodiments" in this description do not necessarily refer to the same embodiment and are not mutually exclusive unless so stated. Specifically, a feature, structure, act, etc. described in one embodiment may also be included in other embodiments, but is not necessarily included. Thus, particular implementations of the present invention can include a variety of combinations and/or integrations of the embodiments described herein.

In this description, references to an "installed" configuration shall mean that a coupling rod has at least been extended from a male cavity to occupy an adjacent female cavity and has reached an approximate final lateral position therein in preparation for finalizing installation; provided, however, that an "installed" configuration can also refer to a configuration that has been subjected to additional steps such as vertical positioning of the coupling rod, grouting and/or other steps described herein.

Furthermore, directional references (e.g., top, bottom, left, right, front, back, up, down, etc.) are used herein solely for the sake of convenience and should be understood only in relation to each other. For instance, a component might in practice be oriented such that faces referred to as "top" and "bottom" are sideways, angled, inverted, etc. relative to the chosen frame of reference.

It is also noted that, as used herein, the terms axial, axially, and variations thereof mean the defined element has at least some directional component along or parallel to the axis. These terms should not be limited to mean that the element extends only or purely along or parallel to the axis. For example, the element may be oriented at a forty-five degree (45°) angle relative to the axis but, because the element extends at least in part along the axis, it should still be considered axial. Similarly, the terms radial, radially, and variations thereof shall be interpreted to mean the element has at least some directional component in the radial direction relative to the axis.

It is further noted that the term annular shall be interpreted to mean that the referenced object extends around a central opening so as to be generally toroidal or ring-shaped. It is not necessary for the object to be circular, nor does the object have to be continuous. Similarly, the term toroidal shall not be interpreted to mean that the object must be circular or continuous.

The inventors hereby state their intent to rely on the Doctrine of Equivalents to determine and assess the reasonably fair scope of the present invention as pertains to any apparatus not materially departing from but outside the literal scope of the invention set forth in the following claims.

What is claimed is:

1. A system for coupling a pavement slab to an adjacent receiving structure, the system comprising:

a substantially horizontal first cavity in the slab terminating along a side of the slab;

a substantially horizontal second cavity in the receiving structure terminating along a side of the receiving structure, the side of the receiving structure being positioned adjacent to the side of the slab;

a coupling rod having a first portion received within the first cavity and a second portion received within the second cavity; and a spacer including a seating surface configured to receive a lower surface of the coupling rod and an alignment surface for positioning in alignment with a landmark segment of the slab;

the alignment surface including a projection and the landmark segment of the slab including a portion of a top surface of the slab having a shape complementary to the projection.

2. The system of claim 1, wherein the alignment surface is additionally configured to bear a load received from the coupling rod along the seating surface.

3. The system of claim 1, wherein the projection includes a nib.

4. The system of claim 1, wherein the seating surface includes a curved projection and the lower surface of the coupling rod is correspondingly curved.

5. The system of claim 1, wherein the spacer extends through a passage extending from a top of the first cavity and terminating at a top surface of the slab.

6. The system of claim 5, further comprising a second spacer for positioning in alignment with a second landmark segment of the receiving structure.

7. The system of claim 1, wherein the spacer is configured so that alignment of the alignment surface with the landmark segment of the slab creates a pre-determined degree of separation between the coupling rod and an inner surface of the first cavity.

8. The system of claim 7, wherein the first cavity and the coupling rod are substantially cylindrical, and wherein the pre-determined degree of separation is approximately one-half inch (½").

9. A system for coupling a pavement slab to an adjacent receiving structure, the system comprising:

a substantially horizontal first cavity in the slab terminating along a side of the slab;

a substantially horizontal second cavity in the receiving structure terminating along a side of the receiving structure, the side of the receiving structure being positioned adjacent to the side of the slab;

a coupling rod having a first portion received within the first cavity and a second portion received within the second cavity;

a spacer including a seating surface configured to receive a lower surface of the coupling rod and an alignment surface for positioning in alignment with a landmark segment of the slab, the spacer extending through a passage extending from a top of the first cavity and terminating at a top surface of the slab; and a second spacer for positioning in alignment with a second landmark segment of the receiving structure, the second spacer extending through a second passage extending from a top of the second cavity and terminating at a top surface of the receiving structure.

10. The system of claim 9, wherein each of the spacers is configured for manual vertical adjustment during installation for alignment with respective landmark segments.

11. The system of claim 10, wherein each of the landmark segments of the slab and of the receiving structure includes respectively the top surface of the slab and the top surface of the receiving structure.

12. The system of claim 10, the system further including a filler substantially occupying the first and second cavities following vertical adjustment of the spacers.

13. The system of claim 10, wherein the first cavity is configured to accommodate substantially the entire length of the coupling rod and the first passage is positioned along a lateral axis at least partially above a first end of the coupling rod in an installed, extended configuration.

14. The system of claim 13, further including a third passage positioned along a lateral axis at least partially above the first end of the coupling rod in a retracted, uninstalled configuration.

15. The system of claim 14, further comprising a flexible snake configured for insertion into the third passage to urge the coupling rod into the second cavity in a telescoping movement for the installed, extended configuration.

16. The system of claim 12, wherein the filler is grout.

17. The system of claim 15, wherein the second passage is positioned along a lateral axis at least partially above the second end of the coupling rod in the installed, extended configuration.

18. The system of claim 17, wherein the second cavity includes a stopping surface configured to resist further penetration into the receiving structure by the coupling rod in the installed, extended configuration.

19. A method for installing adjacent pavement slabs, the steps of the method comprising:

aligning a cavity terminating in a side of a first slab with a matching cavity terminating in a side of a receiving structure; and adjusting the position of a coupling rod, the coupling rod being at least partially within the cavity and at least partially within the matching cavity;

wherein the adjustment of the position of the coupling rod includes manipulating a spacer to achieve a pre-determined degree of separation from a surface of at least one of the cavity and the matching cavity, the spacer having: (A) a seating surface including a curved projection configured to receive a correspondingly curved lower surface of the coupling rod, the adjusting including positioning the lower surface of the coupling rod on the curved projection; and (B) an alignment surface configured for positioning in alignment with a landmark segment of one of the first slab and the receiving structure to achieve the pre-determined degree of separation.

20. The method of claim 19, wherein the adjustment includes manipulating a second spacer.

21. The method of claim 20, wherein each of the spacers is configured for manual substantially vertical adjustment during installation.

22. The method of claim 19, further including the step of injecting a filler to substantially occupy the cavity and the matching cavity following completion of the adjustment of the coupling rod.

23. The method of claim 19, further including the step of extending, prior to the adjustment step, the coupling rod from the cavity into the matching cavity in a telescoping motion.

24. The method of claim 23, wherein the extension of the coupling rod is effected using a flexible snake applied to the coupling rod through a passage configured to permit the flexible snake to push the coupling rod.

25. The method of claim 19, further comprising the step of grouting a bottom surface of the first slab.

26. A method for installing adjacent pavement slabs, the steps of the method comprising:

aligning a cavity terminating in a side of a first slab with a matching cavity terminating in a side of a receiving structure; and adjusting the position of a coupling rod, the coupling rod being at least partially within the cavity and at least partially within the matching cavity;

wherein— the adjustment of the position of the coupling rod includes manipulating a spacer to achieve a pre-determined degree of separation from a surface of at least one of the cavity and the matching cavity, the alignment surface includes a projection and the landmark segment includes a portion of a top surface of one of the first slab and the receiving structure, the manipulating including aligning the projection with the landmark segment to achieve the pre-determined degree of separation.

27. The method of claim 26, further including the step of resting the projection of the spacer on the landmark segment and injecting grout into the cavity.

* * * * *